US007862300B2

(12) United States Patent
Nadvit et al.

(10) Patent No.: US 7,862,300 B2
(45) Date of Patent: Jan. 4, 2011

(54) TURBOMACHINERY BLADE HAVING A PLATFORM RELIEF HOLE

(75) Inventors: Gregory M. Nadvit, Hampden, MA (US); Andrew D. Williams, Balcraig (GB); Leone J. Tessarini, Baden (CH); Michel P. Arnal, Turgi (CH)

(73) Assignee: Wood Group Heavy Industrial Turbines AG, Neuenhof (CH)

( * ) Notice: Subject to any disclaimer, the term of this patent is extended or adjusted under 35 U.S.C. 154(b) by 821 days.

(21) Appl. No.: 11/383,988

(22) Filed: May 18, 2006

(65) Prior Publication Data

US 2007/0269313 A1 Nov. 22, 2007

(51) Int. Cl.
*F01D 5/12* (2006.01)

(52) U.S. Cl. ..... 416/193 A

(58) Field of Classification Search ..... 416/193 A
See application file for complete search history.

(56) References Cited

U.S. PATENT DOCUMENTS

| | | | | |
|---|---|---|---|---|
| 5,096,379 | A * | 3/1992 | Stroud et al. | 416/97 R |
| 6,071,075 | A * | 6/2000 | Tomita et al. | 416/97 R |
| 6,120,249 | A * | 9/2000 | Hultgren et al. | 416/193 A |
| 6,190,128 | B1 * | 2/2001 | Fukuno et al. | 416/96 R |
| 6,390,775 | B1 * | 5/2002 | Paz | 416/193 A |
| 6,722,852 | B1 | 4/2004 | Wedlake et al. | |
| 6,857,855 | B1 | 2/2005 | Snook et al. | |
| 6,893,216 | B2 | 5/2005 | Snook et al. | |
| 7,063,509 | B2 | 6/2006 | Snook et al. | |
| 2005/0058545 | A1 * | 3/2005 | Cardenas | 416/97 R |
| 2005/0095129 | A1 * | 5/2005 | Benjamin et al. | 416/97 R |
| 2006/0056969 | A1 * | 3/2006 | Jacala et al. | 416/97 R |
| 2007/0269316 | A1 | 11/2007 | Williams et al. | |

* cited by examiner

*Primary Examiner*—Richard Edgar
(74) *Attorney, Agent, or Firm*—Baker Botts L.L.P.

(57) ABSTRACT

A turbomachinery blade having a relief hole in its platform and a method of limiting the formation and/or propagation of cracks in the trailing edge of the blade are provided. The relief hole may be formed in the concave side of the platform proximate the trailing edge along its mean camber line. The relief hole may be circular in cross-section and is blind, i.e., does not exit on any other face of the platform. The relief hole prevents the formation of cracks in the trailing edge of the blade and also slows the propagation of any cracks which may have formed in this region of the blade.

20 Claims, 6 Drawing Sheets

TURBOMACHINERY BLADE HAVING A PLATFORM RELIEF HOLE

FIELD OF THE INVENTION

The present invention relates generally to techniques for reducing cracks in gas turbine rotor blades and/or compressor blades in their trailing edges and more specifically to a turbomachinery blade having a relief hole formed in its platform adjacent its trailing edge.

BACKGROUND

The turbine section of gas turbine engines typically comprise multiple sets or stages of stationary blades, known as nozzles or vanes, and moving blades, known as rotor blades or buckets. FIG. 1 illustrates a typical rotor blade 100 found in the first stage of the turbine section, which is the section immediately adjacent the combustion section of the gas turbine and thus is in the region of the turbine section that is exposed to the highest temperatures. A known problem with such blades 100 is premature cracking 104. As shown in FIG. 1, the cracking 104 typically commences at a root trailing edge cooling hole 110*a* located on a trailing edge 112 of an airfoil 102 of the blade 100 adjacent the platform 108. This root trailing edge cooling hole 110*a* is particularly vulnerable to thermal mechanical fatigue (TMF) because of excessive localized stress that occurs during start-stop cycles and creep damage that occurs under moderate operating temperatures, i.e., during periods of base load operation. Because the root trailing edge cooling hole 110*a* is affected by both mechanisms, premature cracking 104 has been reported within the first hot gas path inspection cycle. If the cracking 104 is severe enough, it can force early retirement of the blade 100. In order to prevent this early retirement, various approaches have been proposed.

In one such solution, an undercut is machined into the blade platform. An example of such an undercut can be found in FIG. 2, which illustrates an elliptical-shaped groove 150 which extends from the concave side of platform to the trailing edge side of the platform. This proposed solution purports to reduce the total stress level in the region of high stress, for example proximate the cooling hole closest to the platform in the root portion of the trailing edge.

The goal of the undercut approach is to alleviate both the mechanical stress and the thermal stress in this location by relaxing the rigidity of that juncture where the airfoil and platform join. This approach has been implemented on both turbine and compressor blades as both a field repair and a design modification. If a stress reduction is achieved in the airfoil root region, the concern is whether the undercut results in a high stress within the grooved region where material is removed. In other words, the success of the strategy turns on whether a balance can be achieved without creating a new area of stress within the blade.

There are two primary concerns raised with platform undercuts. First, whether the undercut will be effective in reducing the stress at the trailing edge. Second, whether the stress produced in the undercut will be so high that it offsets the benefit of the undercut. The problem with prior undercut solutions is that they have had difficulty striking that balance. It is desired to have a solution which reduces the stress at the trailing edge, but minimizes the stress formed in the region of the undercut. The present invention seeks to solve this problem.

SUMMARY

In one embodiment, the present invention is directed to a turbine blade which limits trailing edge cracking. The turbine blade has of an airfoil connected to a platform in a root region. The airfoil has a trailing edge which extends from the root region to a tip distal from the root region. The turbine blade limits trailing edge cracking via a relief hole formed in the platform proximate the trailing edge. In one embodiment, the relief hole is formed in the concave side of the platform. The relief hole may also have a centerline which is aligned with a mean camber line at the trailing edge.

In another embodiment, the present invention is directed to a method of limiting cracking in a turbine blade. The method includes the step of forming a relief hole in the platform of the turbine blade proximate the trailing edge. In one embodiment, the relief hole is machined into the concave side of the platform aligned with a mean camber line at the trailing edge.

BRIEF DESCRIPTION OF THE DRAWINGS

The following drawings form part of the present specification and are included to further demonstrate certain aspects of the present invention. The present invention may be better understood by reference to one or more of these drawings in combination with the description of embodiments presented herein. However, the present invention is not intended to be limited by the drawings.

DETAILED DESCRIPTION

Figure 1:
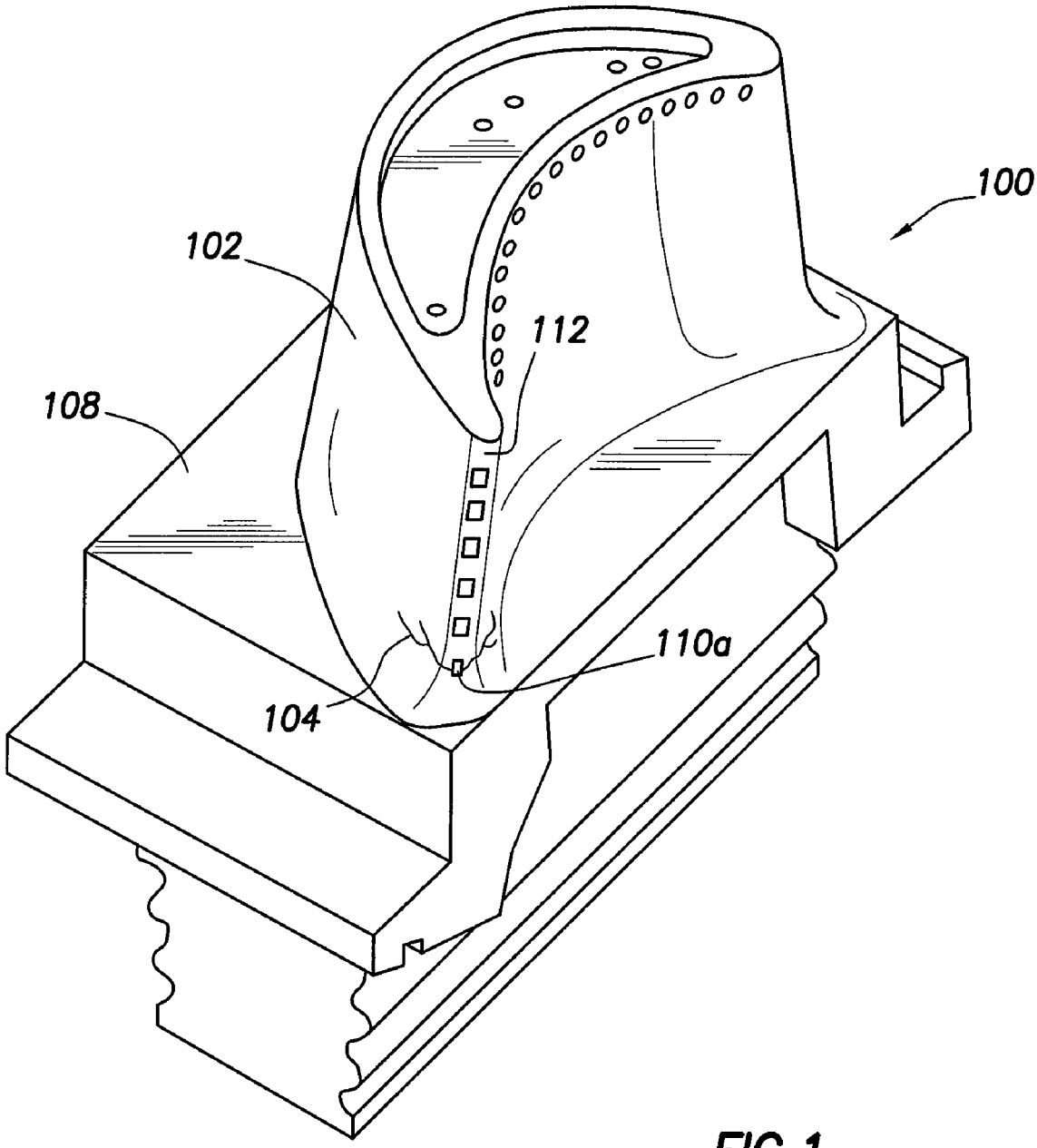
FIG. 1 (PRIOR ART)
FIG. 1 is a perspective view of a prior art rotor blade having cracks formed in its trailing edge proximate the platform.
Figure 2:
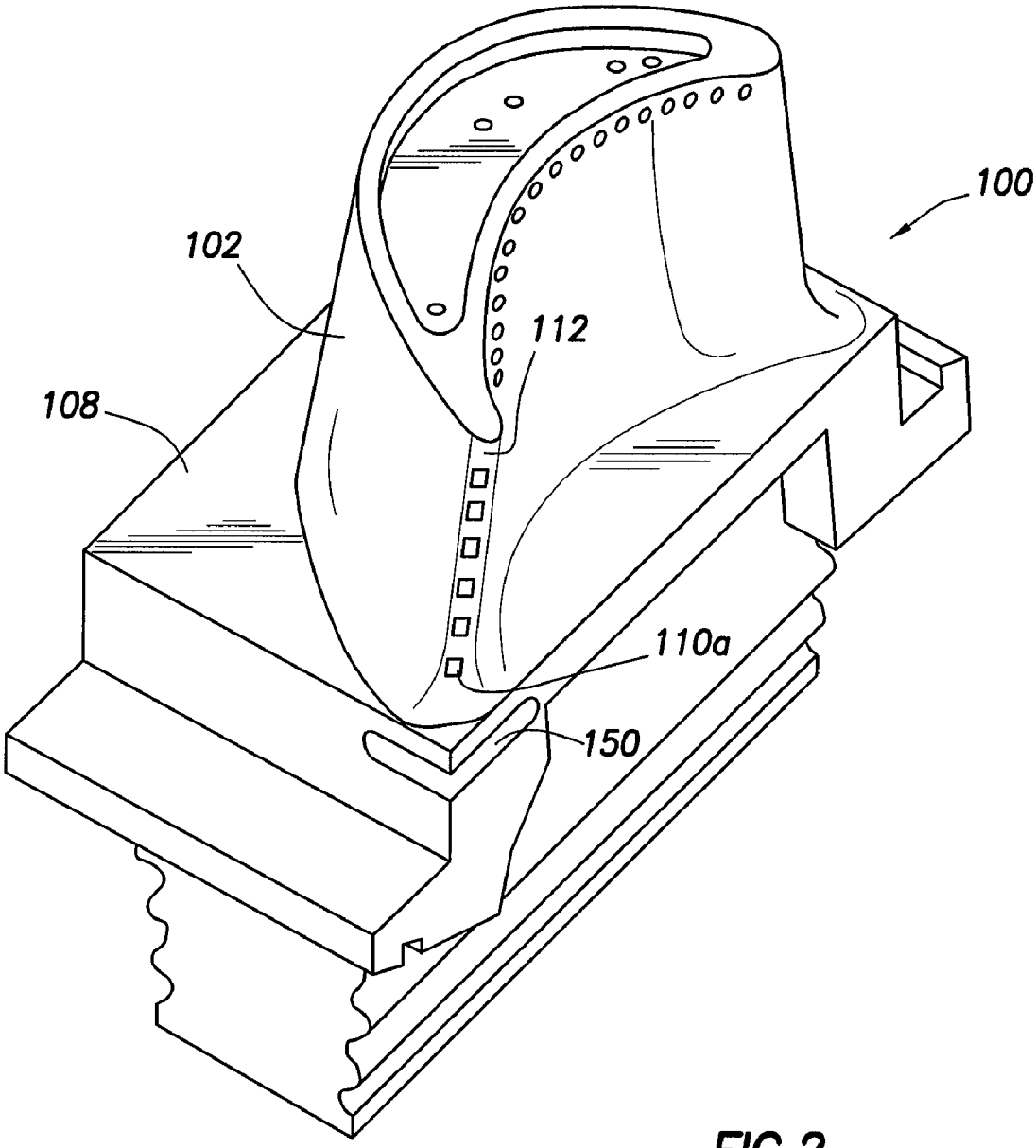
FIG.2 (PRIOR ART)
FIG. 2 is perspective view of a prior art rotor blade having an elliptically-shaped groove formed in its platform proximate the trailing edge which seeks to reduce the stress in the trailing edge.
Figure 3:
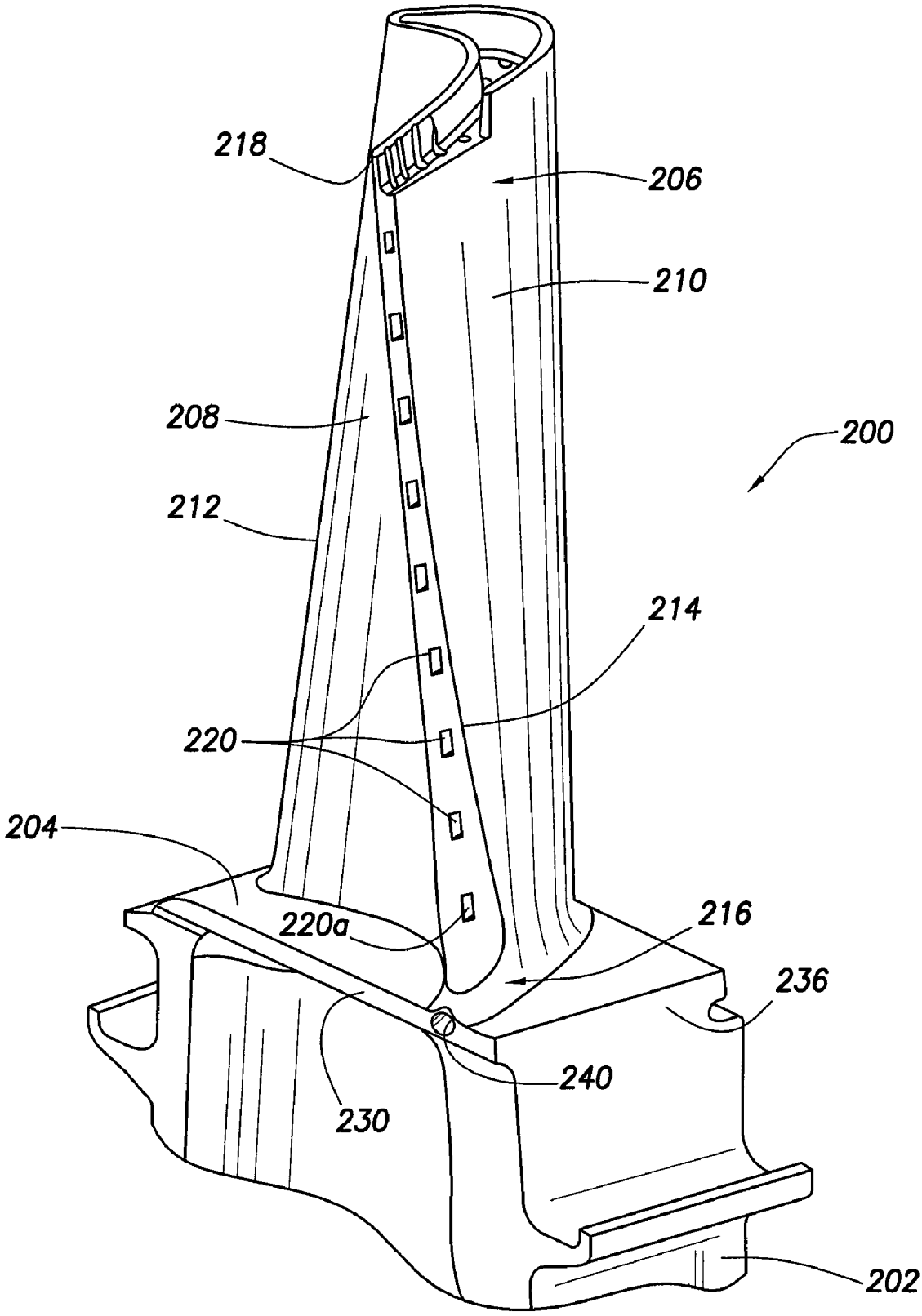
FIG. 3 is a perspective view of a rotor blade in accordance with the present invention having a blind relief hole formed in the concave side of the platform.
Figure 4:
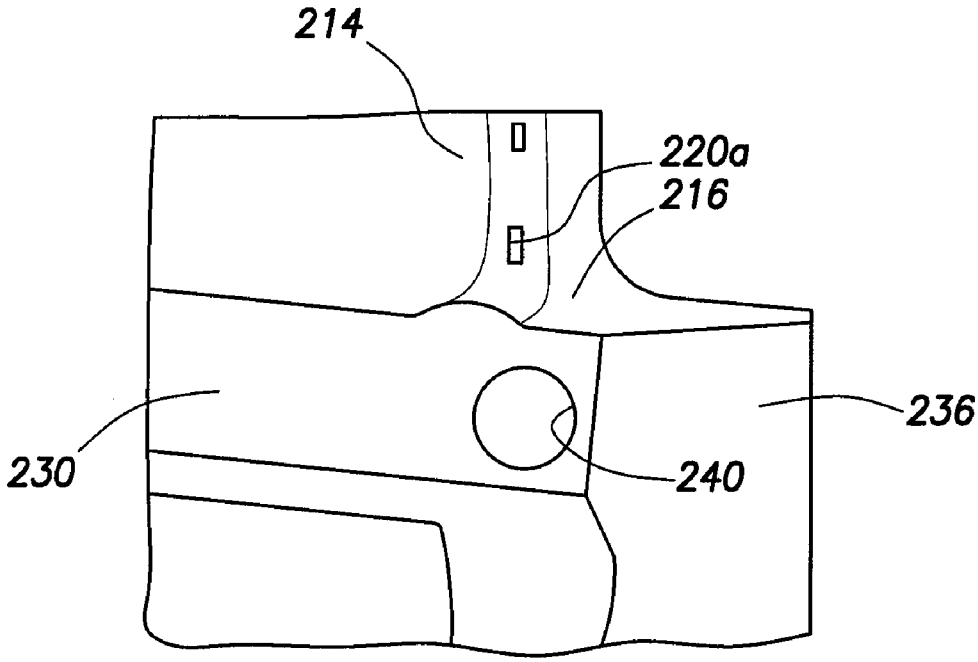
FIG. 4 is an enlarged view of a portion of the rotor blade shown in FIG. 3 showing the blind relief hole in greater detail.

The present invention will now be described with reference to the following exemplary embodiments. Referring now to FIG. 3, a turbine blade in accordance with the present invention is shown generally by reference number 200. The turbine blade 200 has three primary sections a shank 202 which is designed to slide into a disc on the shaft of the rotor (not shown), a platform 204 connected to the shank 202 and an airfoil 206 connected to the platform. Generally, during the blade's 200 initial manufacture, the shank 202, platform 204 and airfoil 206 are all cast as a single part.

The airfoil 206 is defined by a concave side wall 208, a convex side wall 210, a leading edge 212 and opposite trailing edge 214; the leading and trailing edges being the two areas where the concave side wall and convex side wall meet. The airfoil 206 has a root 216 which is proximate the platform 204 and a tip (or shroud) 218 which is distal from the platform. As with prior art turbine blades, air is supplied to the inside cavity of the airfoil 206 (not shown) from the compressor to cool the inside of the airfoil. The cooling air may exit through a plurality of cooling holes 220, at least some of which may be formed in the trailing edge 214. The cooling hole nearest the root of the blade 220*a* is the one where the cracking 104 typically takes place. It is the prevention of the formation of these cracks and a control of their future propagation to which the present invention is directed.

Figure 5:
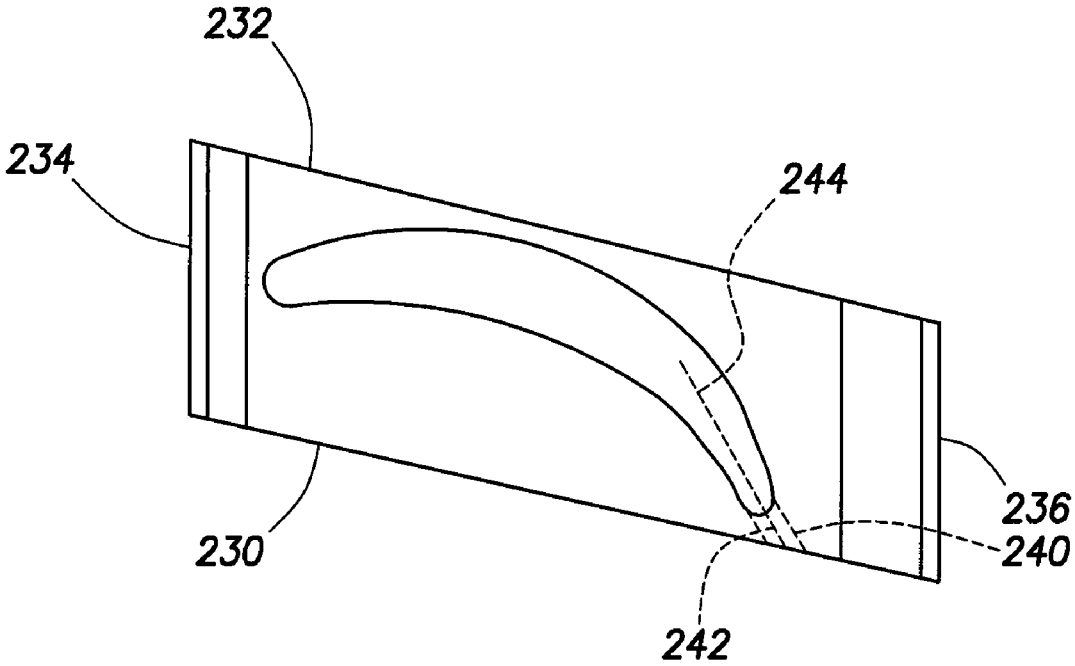
FIG. 5 is a cross-sectional view of the platform showing the orientation of the blind relief hole along the mean camber line of the trailing edge.

The platform 204 has a concave side 230, a convex side 232, a leading edge side 234, and a trailing edge side 236, as shown in FIG. 5. In the concave side 230 of the platform 204 proximate the trailing edge, a relief hole 240 is formed. In accordance with the method of the present invention, the relief hole 240 may be machined into the platform via shape tube electrochemical machining, electro chemical drilling, or electrical discharge machining. Alternatively, the relief hole 240 may be cast.

In one exemplary embodiment, the relief hole 240 is a blind hole, i.e., it does not exit on any other face of the platform 204, but may be any suitably sized and shaped opening or cavity. The relief hole 240 is desirably cylindrical in shape having a circular cross-section. However, as those of ordinary skill in the art will appreciate, the relief hole 240 can have other suitable geometric configurations.

In one exemplary embodiment, the relief hole 240 enters the platform 204 at the approximate midpoint of its thickness in line with the trailing edge 214. The relief hole has a centerline 242 that is aligned with the mean camber line 244 at the trailing edge 214, as shown in FIG. 5. This allows the relief hole 240 to align with stresses on the blade 200, causing the load path to move away from the root region 216. This results in reduction in stress at the root trailing edge cooling hole 220*a*. Since the relief hole 240 is relatively small, it has a much smaller effect on blade natural frequencies than grooves extending from one face of the platform to another face of the platform. While the relief hole 240 may have any suitable dimensions, desirable dimensions may include a diameter of approximately 75% of the platform thickness and a depth of up to 2 hole diameters with the full diameter being maintained throughout the entire depth.

The thermal response for the blade 200 having the relief hole 240 is basically unchanged when compared to the original configuration. The relief hole 240 significantly reduces the maximum principal stress at the root trailing edge cooling hole 220*a*. The TMF life at trailing edge 214 also increases significantly with the implementation of the relief hole 240. Stress near the relief hole 240 is comparable and slightly lower than that at the trailing edge 214. In one representative case, the maximum principal stress was reduced 17% and the TMF life increased by approximately 150%. Therefore, the benefit of the relief hole 240 is believed to be substantial.

Figure 6:
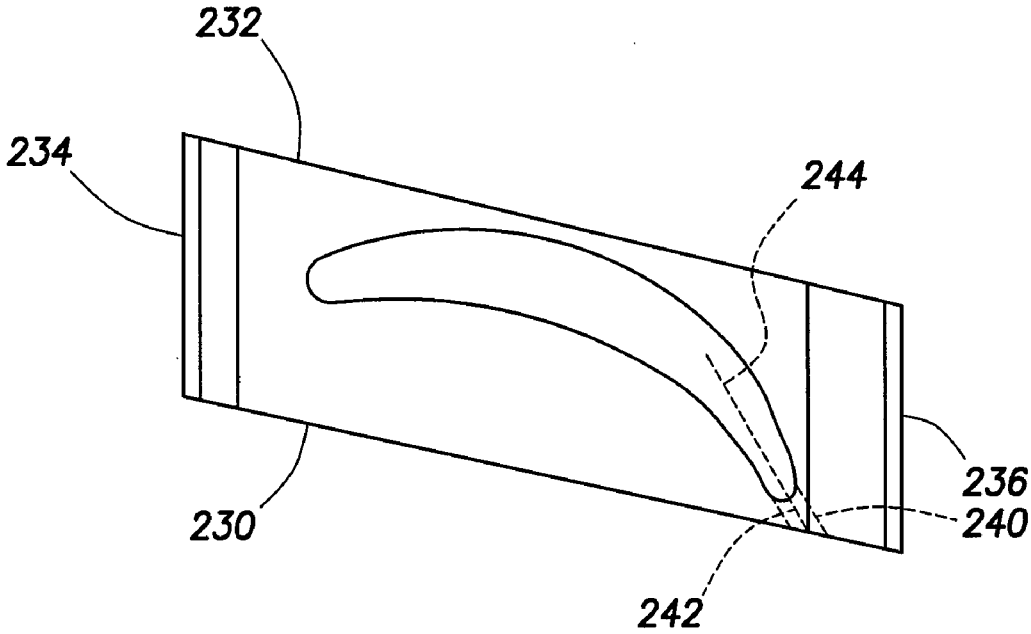
FIG. 6 is a cross-sectional view of the platform showing an alternate orientation of the blind relief hole.
Figure 7:
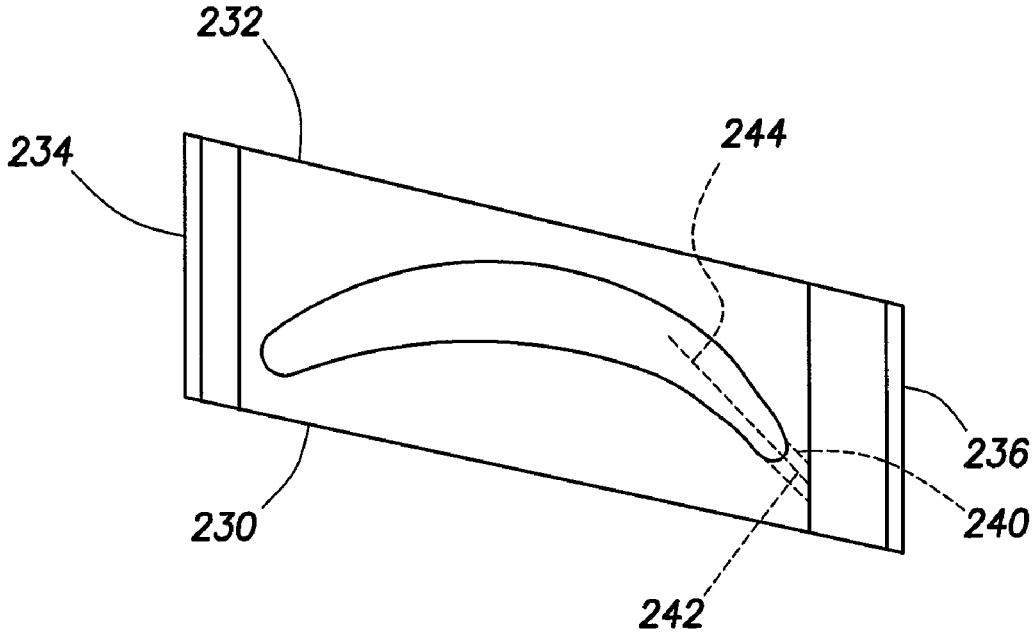
FIG. 7 is a cross-sectional view of the platform showing an alternate orientation of the blind relief hole.
Figure 8:
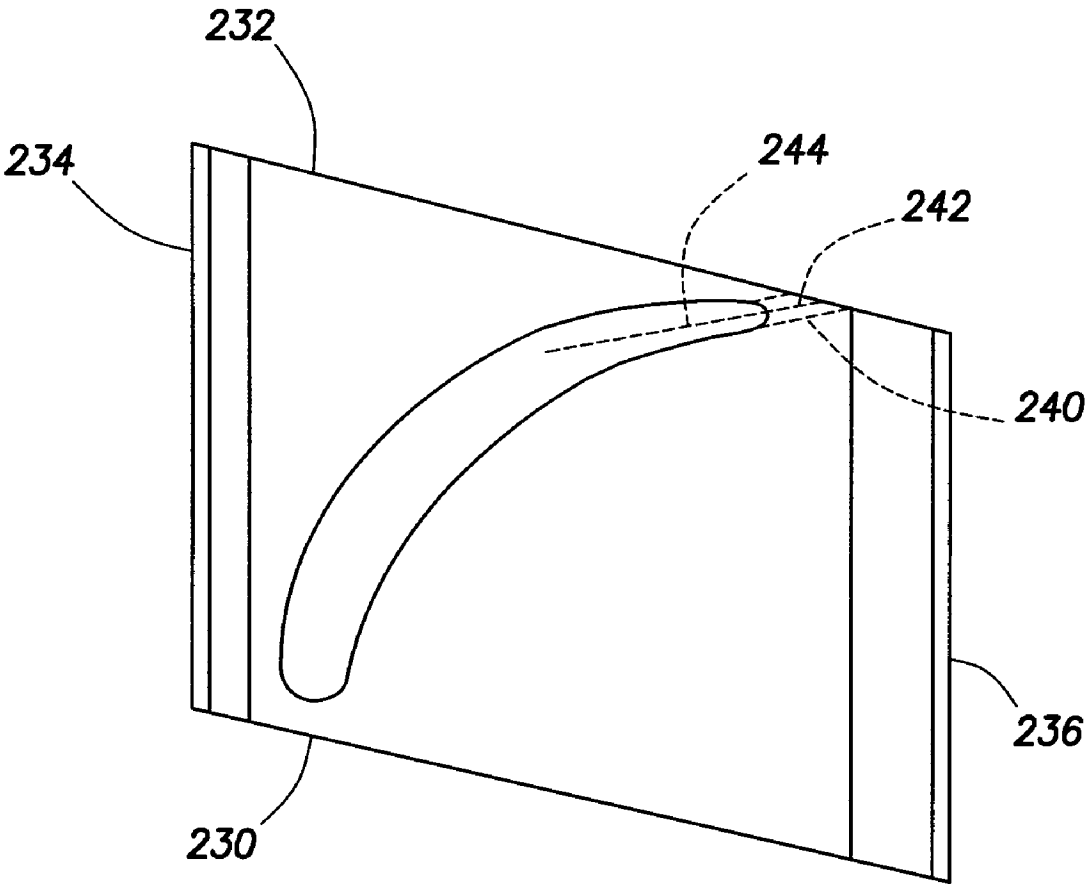
FIG. 8 is a cross-sectional view of the platform showing an alternate orientation of the blind relief hole.

While the relief hole 240 is shown in the concave side 230 of the platform 204, and aligned with the mean camber line 244, the relief hole 240 may be in the convex side 232 as shown in FIG. 8, or the trailing edge side 236 as shown in FIG. 7. Additionally, the relief hole 240 may be at a corner where the trailing edge side 236 and the convex side 232 intersect as shown in FIG. 6, or at any other suitable location. Additionally, the relief hole 240 may be situated such that it does not align with the camber line 244.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A turbomachinery blade having an airfoil connected to a platform in a root region, the airfoil having a trailing edge extending from the root region to a tip distal from the root region, the turbomachinery blade comprising a blind relief hole in the platform proximate the trailing edge.

2. The turbomachinery blade according to claim 1, wherein the relief hole has a centerline which aligns with a mean camber line at the trailing edge.

3. The turbomachinery blade according to claim 1, wherein the platform has a concave side, a convex side opposite the concave side, a trailing edge side and leading edge side opposite the trailing edge side, and wherein the relief hole is formed only in the concave side of the platform.

4. The turbomachinery blade according to claim 3, wherein the platform has a defined thickness and the relief hole is aligned at the approximate mid-point of the thickness.

5. The turbomachinery blade according to claim 3, wherein the relief hole is generally cylindrical in shape.

6. The turbomachinery blade according to claim 5, wherein the relief hole has a diameter of about 75% of the platform thickness.

7. The turbomachinery blade according to claim 1, wherein the platform has a concave side, a convex side opposite the concave side, a trailing edge side and leading edge side opposite the trailing edge side, and wherein the relief hole is formed only in the trailing edge side of the platform.

8. The turbomachinery blade according to claim 1, wherein the platform has a concave side, a convex side opposite the concave side, a trailing edge side and leading edge side opposite the trailing edge side, and wherein the relief hole is formed only in the convex side of the platform.

9. The turbomachinery blade according to claim 1, wherein the platform has a concave side, a convex side opposite the concave side, a trailing edge side and leading edge side opposite the trailing edge side, and wherein the relief hole is formed only in an intersection between the convex side of the platform and the trailing edge of the platform.

10. The turbomachinery blade according to claim 1, wherein the relief hole has a depth that is as much as twice its diameter.

11. A method of limiting cracking in a turbomachinery blade having an airfoil connected to a platform in a root region, the airfoil having a trailing edge extending from the root region to a tip distal from the root region, the method comprising the step of forming a blind relief hole in the platform proximate the trailing edge.

12. The method according to claim 11, wherein the relief hole is formed by machining the relief hole into the platform.

13. The method according to claim 12, wherein machining the relief hole comprises electro chemical drilling.

14. The method according to claim 12, wherein machining the relief hole comprises shape tube electrochemical machining.

15. The method according to claim 12, wherein the relief hole is formed along a mean camber line at the trailing edge.

16. The method according to claim 12, wherein the relief hole is formed only in the concave side of the platform.

17. The method according to claim 12, wherein the platform has a thickness and the relief hole is formed with a centerline aligned at the approximate mid-point of the thickness.

18. The method according to claim 12, wherein the relief hole is formed in a generally cylindrical shape.

19. The method according to claim 18, wherein the relief hole has a diameter of about 75% of the platform thickness.

20. The method according to claim 12, wherein the relief hole has a depth that is as much as twice its diameter.

* * * * *